US008475130B2

(12) United States Patent
Spaggiari

(10) Patent No.: US 8,475,130 B2
(45) Date of Patent: Jul. 2, 2013

(54) AXIAL FLOW FAN

(75) Inventor: Alessandro Spaggiari, Correggio (IT)

(73) Assignee: SPAL Automotive S.r.l. (IT)

( * ) Notice: Subject to any disclaimer, the term of this patent is extended or adjusted under 35 U.S.C. 154(b) by 689 days.

(21) Appl. No.: 12/671,784

(22) PCT Filed: Jul. 23, 2008

(86) PCT No.: PCT/IB2008/002000

§ 371 (c)(1),
(2), (4) Date: Feb. 2, 2010

(87) PCT Pub. No.: WO2009/019559

PCT Pub. Date: Feb. 12, 2009

(65) Prior Publication Data

US 2011/0229330 A1 Sep. 22, 2011

(30) Foreign Application Priority Data

Aug. 7, 2007 (IT) ..... BO2007A0577

(51) Int. Cl.
*F01D 5/14* (2006.01)

(52) U.S. Cl.
USPC ..... 416/169 A; 416/183; 416/189; 416/228; 416/235

(58) Field of Classification Search
USPC ..... 416/169 A, 183, 189, 228, 235
See application file for complete search history.

(56) References Cited

U.S. PATENT DOCUMENTS

| | | | | |
|---|---|---|---|---|
| 2,957,621 | A * | 10/1960 | Haims | 416/223 R |
| 5,064,345 | A * | 11/1991 | Kimball | 416/169 A |
| 5,226,783 | A * | 7/1993 | Mita | 416/223 R |
| 6,210,118 | B1 * | 4/2001 | Egawa et al. | 416/243 |
| 6,584,799 | B2 * | 7/2003 | Jung et al. | 416/228 |
| 8,197,217 | B2 * | 6/2012 | Yamamoto et al. | 416/228 |

FOREIGN PATENT DOCUMENTS

| | | |
|---|---|---|
| DE | 4124891 | 2/1992 |
| EP | 1577562 | 9/2005 |
| SU | 1486626 | 6/1989 |
| WO | 9107593 | 5/1991 |

OTHER PUBLICATIONS

European Search Report dated Nov. 11, 2008 from counterpart patent application.

* cited by examiner

*Primary Examiner* — Igor Kershteyn
(74) *Attorney, Agent, or Firm* — Timothy J. Klima; Shuttleworth & Ingersoll, PLC

(57) ABSTRACT

An axial flow fan comprises a central hub (2) and a plurality of blades (3), each fixed to the central hub (2) and extending from a respective first end (3*a*) proximal to the hub (2) to a respective second end (3*b*) distal from the hub (2); the blades (3) are inclined at a keying angle (β) to a rotation plane (R) of the fan which also comprises a plurality of aerodynamic protrusions (11), each extending from a first lateral edge (6) of a corresponding blade (3) in the vicinity of its second end (3*b*); each protrusion (11) lies in a plane (PP) perpendicular to an axis (A) of fan rotation.

18 Claims, 3 Drawing Sheets

AXIAL FLOW FAN

CROSS-REFERENCE TO RELATED APPLICATIONS

This application is the National Phase of International Application PCT/IB2008/002000 filed Jul. 23, 2008 which designated the U.S. and that International Application was published under PCT Article 21(2) in English.

This application claims priority to Italian Patent Application No. B02007A000577 filed Aug. 7, 2007, and PCT Application No. PCT/IB2008/002000 filed Jul. 23, 2008, which applications are incorporated by reference herein.

TECHNICAL FIELD

This invention relates to an axial flow fan.

In particular, this invention applies to driving an air flow axially through a heat exchanger, preferably in a motor vehicle cooling and heating system.

BACKGROUND ART

Fans are known which comprise a central hub to which a plurality of equally spaced blades are connected. The hub is functionally associated with a motor which rotationally drives the fan in such a way as to promote the axial movement of the air flow.

Fans are known where each blade is associated with a respective aerodynamic fin located in the vicinity of the distal end of the blade relative to the hub.

The fin, which is made as single part with the blade, helps increase fan performance in terms of head and/or efficiency compared to fans without these fins.

DISCLOSURE OF THE INVENTION

This invention has for an aim to provide a fan with enhanced performance in terms of head supplied and/or aerodynamic efficiency.

According to the invention, this aim is achieved by an axial flow fan comprising the technical characteristics described in one or more of the appended claims.

BRIEF DESCRIPTION OF THE DRAWINGS

The technical characteristics of the invention, with reference to the above aim, are clearly described in the claims below and its advantages are apparent from the detailed description which follows, with reference to the accompanying drawings which illustrate a preferred embodiment of the invention provided merely by way of example without restricting the scope of the inventive concept, and in which:

DETAILED DESCRIPTION OF THE PREFERRED EMBODIMENTS OF THE INVENTION

Figure 1:
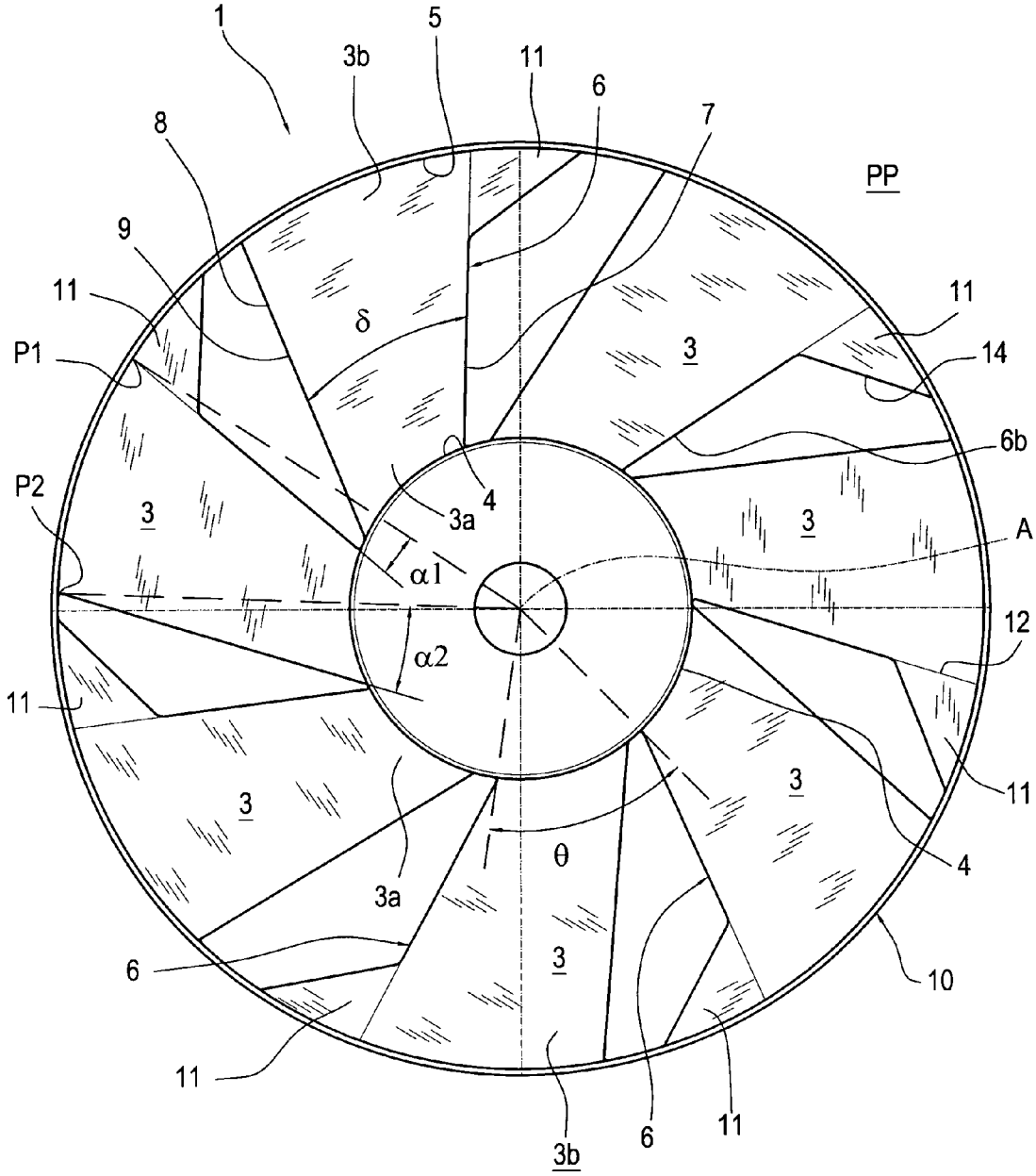
FIG. 1 is a plan view of an axial flow fan according to the invention.

With reference to the accompanying drawings, the numeral 1 denotes in its entirety an axial flow fan according to this invention.

The fan 1 comprises a central hub 2 and a plurality of blades 3 fixed to the hub 2.

The hub 2 is cup-shaped and can be connected to a motor for rotationally driving the fan 1 about its axis of rotation "A" in order to move the air flow axially.

Each blade 3 extends betwen a first end 3*a* proximal to the hub 2 and a second end 3*b*, opposite the first, distal from the hub 2.

In other words, each blade 3 has an inner edge 4 located at the first end 3*a*, rigidly fixed to the hub 2 and having a concave shape.

Each blade 3 also comprises an outer edge 5 located at the second end 3*b* of each blade 3 and having a convex shape.

Each blade 3 also has a first lateral edge 6 which at least partly defines a leading edge 7 of each blade 3 and a second lateral edge 8 which defines a trailing edge 9. The first lateral edge 6 and/or the second lateral edge 8 are straight.

Advantageously, the blades 3 are spaced at equal angular intervals. In the embodiment described, the fan 1 comprises seven blades 3 equally spaced at angular intervals θ substantially equal to 51.4° (FIG. 1).

In this specification, the spacing angle θ of the blades 3 is the angle measured at the axis of rotation "A" between radii passing through corresponding points of each blade 3. With reference in particular to FIG. 1, the spacing angle θ is the angle measured at the axis of rotation "A" between radii passing through the points where the inner edge 4 meets the first lateral edge 6 of two adjacent blades 3.

Figure 3:
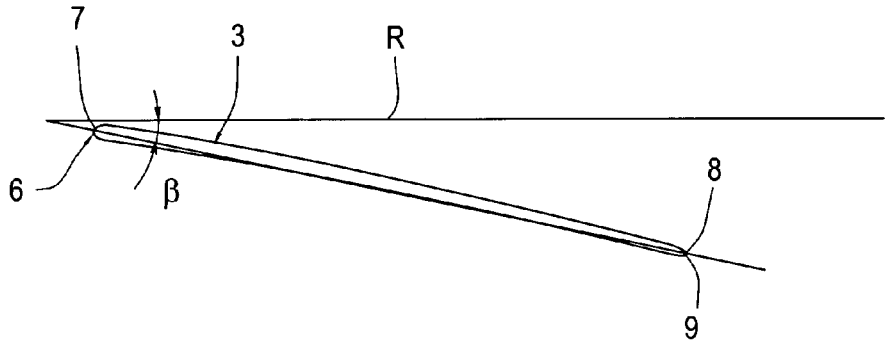
FIG. 3 is a section view of a blade forming part of the fan of FIG. 1.

The blades 3 are rigidly fixed to the hub 2 in such a way that they are inclined at an angle to a rotation plane "R" of the blades 3 themselves. In other words, the blades 3 are positioned in such a way as to make a keying angle β that is not zero (in FIG. 3 the rotation plane "R" is represented by a straight line).

In this specification, "keying angle β" is the angle made by the rotation plane "R" of the fan 1, that is to say, of the blades 3, with a straight line passing through the leading edge 7 and the trailing edge 9 of the aerodynamic profile of a section of the blade 3.

More in detail, each blade 3 has a spiral shape extending from the first end 3*a* to the second end 3*b*.

In other words, each blade 3 is shaped by placing side by side aerodynamic profiles of known geometry and rotating each profile with respect to the one before it in such a way that the keying angle β decreases from the first end 3*a* to the second end 3*b* of each blade 3.

In the embodiment described, the fan 1 also comprises a circular peripheral band 10 that rigidly connects the second ends 3*b* of the blades 3.

More specifically, the peripheral band 10 is rigidly fixed to the outer edges 5 of the blades 3.

Advantageously, the peripheral band 10 stiffens the set of blades 3 in such a way as to prevent the variation of the keying angle β of the blade 3 in a zone near the second end 3*b*. This variation is caused by aerodynamic loads which are higher in the zone near the second ends 3*b* of the blades 3.

The peripheral band 10 also reduces the vortical effect produced at the second ends 3*b* of the blades 3. End vortices are aerodynamic effects produced by the difference between the pressure at the back and the pressure at the front of the blades 3. They reduce the aerodynamic efficiency of the blades 3. Advantageously, therefore, the peripheral band 10 contributes to increasing the efficiency of the fan 1.

The fan 1 also comprises a plurality aerodynamic protrusions 11, each connected to a respective blade 3.

More in detail, each protrusion 11 extends from the first lateral edge 6 in the vicinity of the second end 3*b* of each blade 3. Further, the protrusions 11 are co-planar and lie in a plane "PP" perpendicular to the axis of rotation "A" of the fan 1.

As illustrated, the plane "PP" is parallel to the rotation plane "R".

Each protrusion 11 is substantially triangular in shape and has a border 12 that connects it to the respective blade 3. In particular, the connecting border 12 is rigidly connected to an end portion 6*a* of the first lateral edge 6 of the blade 3.

Also, each protrusion 11 has an outer edge 13 that extends along a circular arc whose centre is at the axis of rotation "A".

More in detail, the outer edge 5 of the blade 3 and the outer edge 13 of the protrusion 11 extend uninterruptedly. Further, a projection of the outer edge 5 of the blade 3 onto the perpendicular plane "PP" and the outer edge 13 of the protrusion 11 lie on the same circular arc whose centre is at the axis of rotation "A" of the fan 1.

In the embodiment described, the outer edge 13 of each protrusion 11 is also rigidly connected to the peripheral band 10.

Figure 2:
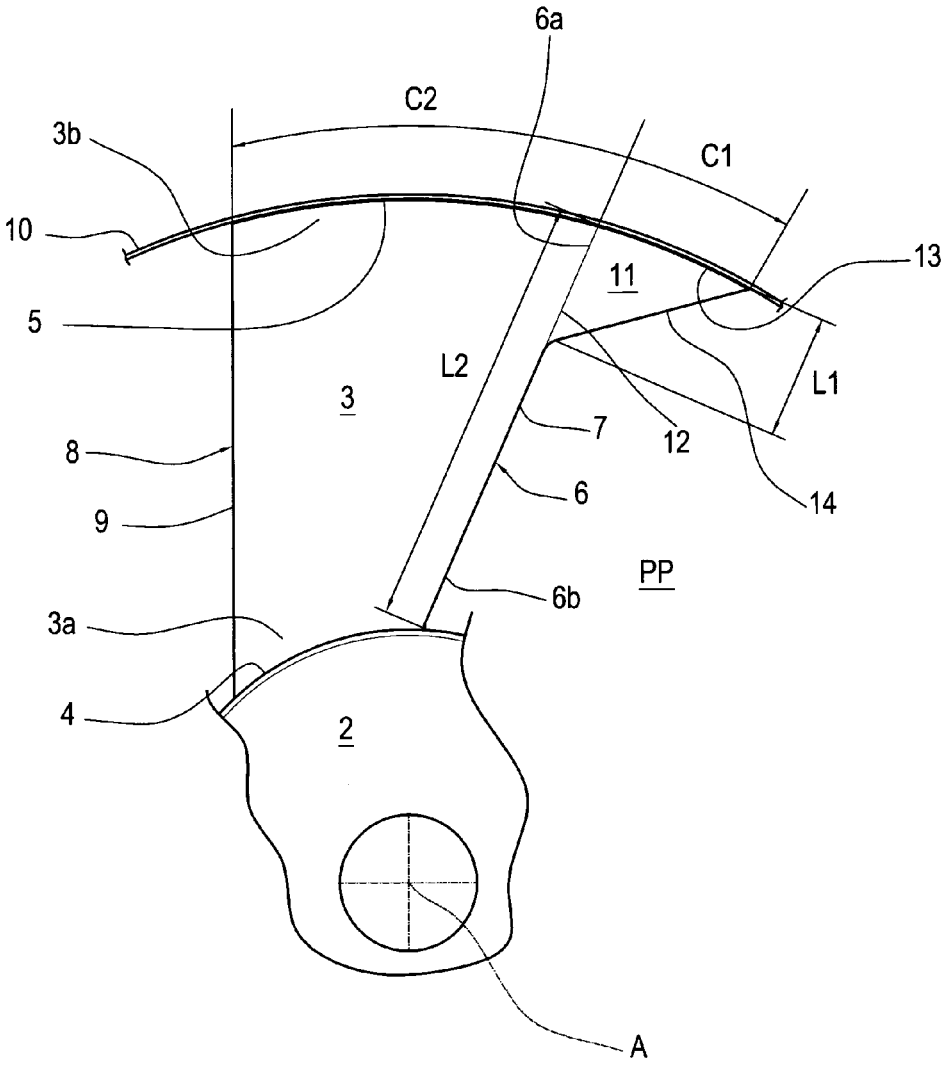
FIG. 2 illustrates a detail of the fan of FIG. 1.

FIG. 2 in particular shows how each protrusion 11 also has an oblique side 14 that joins the connecting border 12 to the outer edge 13 of the protrusion 11.

The oblique side 14 defines at least part of the leading edge 7 of the blade 3.

More in detail, the leading edge 7 is defined by a free portion 6*b* of the first lateral edge 6 of the blade 3 and the oblique side 14 of the protrusion 11. More specifically, the free portion 6*b* of the first lateral edge 6 is the portion of the first edge 6 that extends from the inner edge 4 of the blade 3 to a point where the oblique side 14 of the protrusion 11 meets the first lateral edge 6 of the blade 3.

In the embodiment described, the ratio between a length C1 of the circular arc of the outer edge 13 of each protrusion 11 and a length C2 of the circular arc of a projection of the outer edge 5 of the blade 3 on the perpendicular plane "PP" is between 0.35 and 0.55. Preferably, this ratio is between 0.40 e 0.50. In the embodiment described, this ratio is substantially equal to 0.45 (FIG. 2).

Further, the ratio between a length L1 of the connecting border 12 of each protrusion 11 and a length L2 of the first lateral edge 6 of each blade 3 is between 0.20 and 0.40. Preferably, this ratio is between 0.25 e 0.35. In the embodiment described, this ratio is substantially equal to 0.29 (FIG. 2).

With reference to a projection on the perpendicular plane "PP", the value of an advance angle $\alpha$1 of the first lateral edge 6 of the blade 3 is less than 10°. Preferably, this advance angle $\alpha$1 is between 5° and 9°.

More specifically, the advance angle $\alpha$1 of the first lateral edge 6 of the blade 3 is defined as the angle made by the first lateral edge 6 with a radius passing through a first point "P1" where the outer edge 5 of the blade 3 meets the first lateral edge 6 of the blade 3.

Further, the value of an advance angle $\alpha$2 of the second lateral edge 8 of the blade 3 is less than 20°. Preferably, this advance angle $\alpha$2 is between 13° and 18°.

More specifically, the advance angle $\alpha$2 of the second lateral edge 8 of the blade 3 is defined as the angle made by the second lateral edge 8 with a radius passing through a second point "P2" where the outer edge 5 of the blade 3 meets the second lateral edge 8 of the blade 3.

Each blade 3 makes an angle $\delta$ between the projection of the first lateral edge 6 on the perpendicular plane "PP" and the projection of the second lateral edge 8 on the perpendicular plane "PP". The angle $\delta$ is between 20° and 28°. Preferably, the value of the angle 6 is between 22° and 26°.

It should be stressed that the preferred values of C1/C2, L1/L2, □1, □2 and □ selected from within the above mentioned respective ranges optimize fan performance in terms of air flow and noise compared to fans with straight blades of substantially known type, the general improvement in performance being confirmed by specific tests.

The invention achieves the proposed aim.

Fan 1 performance is appreciably enhanced by the coplanar aerodynamic protrusions 11. This enhanced performance of the fan 1 is achieved in particular in terms of guaranteed head and aerodynamic efficiency.

Another important advantage of the fan 1 according to the invention is its low noise emission.

What is claimed is:

1. An axial flow fan comprising a central hub and a plurality of blades, each fixed to the central hub and extending from a respective first end proximal to the hub to a respective second end distal from the hub; each blade having a first lateral edge which at least partly defines a leading edge of the blade and a second lateral edge which defines a trailing edge of the blade, the blades being inclined at a keying angle with respect to a rotation direction of the blades, the fan further comprising a plurality of aerodynamic protrusions, each protrusion extending from the first lateral edge of the blade in a vicinity of the second end and lying in a plane perpendicular to an axis of fan rotation.

2. The fan according to claim 1, wherein each protrusion has a substantially triangular shape; each protrusion also having a border for connecting to the blade and an outer edge extending along a circular arc concentric with the axis of rotation.

3. The fan according to claim 2, wherein the blade has an outer edge located in the vicinity of the second end; a ratio between a length of the outer edge of each protrusion and a length of a projection of the outer edge of each blade on the plane perpendicular to the axis of fan rotation being between 0.35 and 0.55.

4. The fan according to claim 2, wherein the outer edge of the blade and the outer edge of the protrusion extend uninterruptedly; a projection of the outer edge of the blade on the plane perpendicular to the axis of fan rotation and the outer edge of the protrusion lying on the same circular arc concentric with the axis of rotation.

5. The fan according to claim 2, wherein a ratio between a length of the connecting border of each protrusion and a length of the first lateral edge of each blade is between 0.20 and 0.40.

6. The fan according to claim 1, wherein the first lateral edge of the blade is straight.

7. The fan according to claim 6, wherein an advance angle of the first lateral edge is less than 10°.

8. The fan according to claim 1, wherein the second lateral edge is straight.

9. The fan according to claim 8, wherein an advance angle of the second lateral edge is less than 20°.

10. The fan according to claim 8, wherein an angle, made by the blade between the projection of the first lateral edge on the plane perpendicular to the axis of fan rotation and the projection of the second lateral edge on the plane perpendicular to the axis of fan rotation, is between 20° and 28°.

11. The fan according to claim 1, wherein each blade has a spiral shape extending from the first end to the second end.

12. The fan according to claim 1, and further comprising a peripheral band connecting the second ends of the blades.

13. The fan according to claim 12, wherein each protrusion is rigidly fixed to the peripheral band.

14. The fan according to claim 3, wherein the ratio between the length of the outer edge of each protrusion and the length of the projection of the outer edge of each blade on the plane is between 0.40 and 0.50.

15. The fan according to claim 5, wherein the ratio between the length of the connecting border of each protrusion and a length of the first lateral edge of each blade is between 0.25 and 0.35.

16. The fan according to claim 7, wherein the advance angle of the first lateral edge is between 5° and 9°.

17. The fan according to claim 9, wherein the advance angle of the second lateral edge is between 13° and 18°.

18. The fan according to claim 10, wherein the angle, made by the blade between the projection of the first lateral edge on the plane perpendicular to the axis of fan rotation and the projection of the second lateral edge on the plane perpendicular to the axis of fan rotation, is between 22° and 26°.

* * * * *